US010928018B2

(12) United States Patent
Signorino et al.

(10) Patent No.: US 10,928,018 B2
(45) Date of Patent: Feb. 23, 2021

(54) LIGHT BAR FOR INSTALLATION IN A HOUSEHOLD ELECTRICAL APPLIANCE, SHELF ASSEMBLY AND COOLING APPLIANCE WITH SUCH A SHELF ASSEMBLY

(71) Applicant: emz-Hanauer GmbH & Co. KGaA, Nabburg (DE)

(72) Inventors: Manfredi Signorino, Wackersdorf (DE); Martin Brabec, Nabburg (DE); Johann Schenkl, Bodenwoehr (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 0 days.

(21) Appl. No.: 16/508,350

(22) Filed: Jul. 11, 2019

(65) Prior Publication Data

US 2020/0018451 A1 Jan. 16, 2020

(30) Foreign Application Priority Data

Jul. 11, 2018 (DE) ..... 10 2018 005 481.1

(51) Int. Cl.
*F21S 4/28* (2016.01)
*F25D 27/00* (2006.01)
(Continued)

(52) U.S. Cl.
CPC . *F21S 4/28* (2016.01); *F21S 8/03* (2013.01); *F21V 7/005* (2013.01);
(Continued)

(58) Field of Classification Search
CPC .. F21S 4/28; F21S 8/03; F21V 19/008; F21V 33/0044; F21V 7/005; F21W 2131/305; F21D 27/00
(Continued)

(56) References Cited

U.S. PATENT DOCUMENTS 5,032,960 A * 7/1991 Katoh ..... F21V 5/04 362/240
6,179,434 B1 * 1/2001 Saraiji ..... A47F 3/001 108/23
(Continued)

FOREIGN PATENT DOCUMENTS

CA 2731820 A1 8/2012
DE 102005007839 B3 5/2006
(Continued)

OTHER PUBLICATIONS

German office action dated May 11, 2020 for DE 10 2018 005 481.1.
(Continued)

*Primary Examiner* — Leah Simone Macchiarolo
(74) *Attorney, Agent, or Firm* — Robert R. Deleault, Esq.; Mesmer & Deleault, PLLC

(57) ABSTRACT

A light bar includes an arrangement of several light elements reciprocally spaced behind one another in the longitudinal bar direction where each light element produces a light beam, a reflection surface formed on a light-impermeable reflector body and producing a diffuse scattering effect where a first portion of the light beam of each light element is directed at the reflection surface, a light-permeable window element at which light produced by the light elements exits the light bar. A second portion of the light beam that is different from the first portion is directed past the reflection surface onto the light exit window. The light radiated by the light bar is composed of a direct light proportion and a scattered light proportion, the relative ratio of which in a suitable configuration of the reflector body and the window element can be different in different radiation directions of the light bar.

13 Claims, 5 Drawing Sheets

(51) Int. Cl.

| | |
|---|---|
| ***F21V 33/00*** | (2006.01) |
| ***F21V 7/00*** | (2006.01) |
| ***F21S 8/00*** | (2006.01) |
| *F25D 25/02* | (2006.01) |
| *F21Y 103/10* | (2016.01) |

(52) U.S. Cl.
CPC ..... *F21V 33/0044* (2013.01); *F25D 27/00* (2013.01); *F21Y 2103/10* (2016.08); *F25D 25/02* (2013.01)

(58) Field of Classification Search
USPC ..... 362/92
See application file for complete search history.

(56) References Cited

U.S. PATENT DOCUMENTS

| | | | | |
|---|---|---|---|---|
| 7,588,340 | B2 | 9/2009 | Bauer et al. | |
| 8,104,920 | B2 * | 1/2012 | Dubord | F21V 19/0045 362/217.12 |
| 10,539,316 | B2 * | 1/2020 | Ji | F25D 27/00 |
| 2002/0131275 | A1 * | 9/2002 | Yamamoto | F21S 9/043 362/555 |
| 2003/0137828 | A1 * | 7/2003 | Ter-Hovhannisian | A47F 3/0404 362/92 |
| 2003/0223235 | A1 * | 12/2003 | Mohacsi | F21V 21/005 362/240 |
| 2005/0201098 | A1 | 9/2005 | DiPenti et al. | |
| 2006/0147673 | A1 | 7/2006 | Ueda et al. | |
| 2009/0296383 | A1 * | 12/2009 | Valster | F21V 7/0008 362/231 |
| 2010/0321921 | A1 * | 12/2010 | Ivey | F21K 9/64 362/84 |
| 2011/0019410 | A1 * | 1/2011 | Ibanez | F21V 29/75 362/235 |
| 2011/0058353 | A1 * | 3/2011 | Yang | F21V 7/0033 362/84 |
| 2011/0199767 | A1 * | 8/2011 | Marquardt | F21V 7/16 362/235 |
| 2013/0033888 | A1 * | 2/2013 | Van Der Wel | F21V 7/18 362/555 |
| 2014/0268862 | A1 * | 9/2014 | Gooden | F25D 27/00 362/555 |
| 2016/0025311 | A1 * | 1/2016 | Tischler | H05K 1/189 362/232 |
| 2016/0097492 | A1 | 4/2016 | Tigchelaar et al. | |
| 2016/0109068 | A1 * | 4/2016 | Boonekamp | F21K 9/66 362/218 |
| 2017/0089530 | A1 * | 3/2017 | Jiang | H05B 45/00 |
| 2019/0301792 | A1 * | 10/2019 | Signorino | F21V 7/0008 |

FOREIGN PATENT DOCUMENTS

| | | | |
|---|---|---|---|
| DE | 20 2009 017 408 | U1 | 3/2010 |
| DE | 10 2015 213 577 | A1 | 1/2017 |
| WO | 2011055973 | A2 | 5/2011 |
| WO | 2013034497 | A1 | 3/2013 |
| WO | 2013132383 | A1 | 9/2013 |
| WO | 2013164163 | A1 | 11/2013 |
| WO | 2015110306 | A1 | 7/2015 |

OTHER PUBLICATIONS

German office action dated Jun. 24, 2019 for DE 10 2018 005 481.1 with English transaltion.
Hesse GmbH & Co. KG, Technical data sheet with partial English translation of terms.

* cited by examiner

LIGHT BAR FOR INSTALLATION IN A HOUSEHOLD ELECTRICAL APPLIANCE, SHELF ASSEMBLY AND COOLING APPLIANCE WITH SUCH A SHELF ASSEMBLY

BACKGROUND OF THE INVENTION

1. Field of the Invention

The present invention relates generally to a light bar, which is intended to be installed in a household electrical appliance, for example a refrigerator.

2. Description of the Prior Art

Domestic refrigerators are typically equipped with a lighting device, which, when the door of the refrigerator is opened, illuminates the interior or at least partial areas thereof, so that a user has a better view of the food items located inside. Apart from surface luminaires, which are installed in a partition wall of the refrigerator interior, bar-like elongated light modules are also known in the prior art, which are mounted on a storage shelf, which is used to store foods and can be removed from the refrigerator if necessary, in the area of one of the shelf edges. The light module radiates its light into a spatial area below the storage shelf, for example, and/or into the storage shelf itself, so that the storage shelf appears to be illuminated. For the prior art in respect of such bar-like light modules reference is made by way of example to DE 10 2005 007 839 A1 and WO 2013/164163 A1.

Domestic refrigerators are often equipped with one or more pull-out drawers, in which special climatic conditions prevail, which are coordinated to the storage of fresh foods (vegetables, meat, sausage etc.) that spoil easily. The withdrawal extent of such a drawer is occasionally limited, and if an opaque storage shelf is located immediately above the drawer, satisfactory illumination of the drawer by means of conventional lighting solutions can be difficult to realise. The present invention was conceived not only, but in particular with a view to creating a satisfactory solution for the illumination of a product drawer of a domestic refrigerator.

SUMMARY OF THE INVENTION

According to a first aspect of the invention, a light bar is provided for installation in a household electrical appliance, for example a refrigerator, wherein the light bar comprises an arrangement of a plurality of light elements, in particular in LED construction, arranged behind one another in a mutually spaced manner in a longitudinal bar direction of the light bar, wherein each light element is configured to produce a beam of light. The light bar further comprises a light-impermeable reflector body having a reflection surface, the reflection surface configured to produce a diffusely scattering effect, wherein a first portion of the light beam of each of the plurality of light elements is directed onto the reflection surface, and a light-permeable window element, at which light produced by the light elements exits the light bar. A second portion of the light beam of each of the plurality of light elements different from the first portion is directed in this case past the reflection surface onto the light exit window. In this solution a portion of the light produced by each light element is first scattered at the reflection surface before it exits the light bar through the window element. Another portion of the light travels past the reflection surface directly to the light exit window and can exit the light bar through this. The light radiated by the light bar is accordingly composed of portions which are scattered diffusely by means of reflection on the reflection surface and portions that have passed directly to the light exit window without being scattered previously at the reflection surface.

It has been shown that by such a combination of indirect scattered light portions and direct light portions, satisfactory illumination results can be achieved not only, but in particular also for a pull-out product drawer in a refrigerator. Above all, by suitable configuration of the reflection surface and the window element, influence can be exerted on the composition of the light, which is radiated by the light bar in various directions. With the solution according to the invention, a light bar can thus be realised which—when viewed in a section orthogonal to the longitudinal bar direction of the light bar—radiates light with a relatively higher proportion of indirect scattered light in a first direction and in a second direction, which is offset at an angle of up to around 90 degrees, for example, compared with the first direction, radiates light with a relatively lower proportion of indirect scattered light. On the other hand, the light radiated in the second direction contains a relatively higher proportion of direct light, which is incident directly on the window element without scattering on the reflection surface, than the light radiated in the first direction.

It is possible in this way to combine different illumination objectives successfully. For example, with respect to the light radiated from the light bar in the first direction, it may primarily be a case of avoiding glare effects, which can occur if this light encounters a comparatively glossy surface (for example, a surface on the rear wall of the refrigerator interior or on the rear wall of a product drawer). Such glare effects can be satisfactorily avoided by a comparatively high proportion of indirect scattered light. In the case of the light radiated by the light bar in the second direction, on the other hand, the objective can consist primarily, for example, in achieving the most intense illumination possible and thus good recognisability of the foods that have been placed in a product drawer of the refrigerator. A high proportion of direct light may be required to achieve this objective.

In certain embodiments, when viewed in a section orthogonal to the longitudinal direction of the bar, the first portion and the second portion of the light beam of each light element adjoin one another. In particular, the first portion and the second portion of the light beam fill the entire beam cross section.

In certain embodiments, the first portion and the second portion each comprise at least roughly a fifth or at least roughly a quarter or least roughly a third of the cross section of the light beam. Configurations are conceivable in which the first portion and the second portion each comprise approximately half of the light beam cross section. However, configurations are also possible in which the first portion is greater than the second portion or vice-versa.

In certain embodiments, the light bar—when viewed in a section orthogonal to the longitudinal direction of the bar—has an internal cavity that is closed all around, wherein the light elements are arranged on a circuit board inserted into the internal cavity, in particular with a beam axis of the light beam of each light element at least approximately perpendicular to the board plane of the circuit board.

In certain embodiments, the internal cavity is limited by a cavity surface, which—when viewed in a section orthogonal to the longitudinal direction of the bar—runs in a curve shape at least within the angular range of the light beam of each light element, in particular substantially in the shape of an arc of a circle, curved at a distance from the circuit board. A portion of the cavity surface lying within the angular range of the light beam of each light element is formed in this case in a first partial angular range by the window element, while the reflection surface is arranged within a second partial angular range. In this second partial angular range the cavity surface can be formed directly by the reflection surface. Alternatively it is conceivable that the window element extends into the second partial angular range and in the second partial angular range accordingly borders the internal cavity at least partially. In this alternative configuration the reflector body covers the window element on its outer side facing away from the cavity in the second partial angular range. Where the window element is upstream of the reflection surface, the light of the first portion of the light beam of each light element consequently passes the window element first before it encounters the reflection surface and is scattered diffusely there.

In certain embodiments, a distance of each light element from the cavity surface measured perpendicular to the board plane of the circuit board is greater than a centre distance of consecutive light elements. An adequate mixing of the light of adjacent light elements and thereby an on the whole homogeneous light radiation of the light bar can be achieved by this measure.

In certain embodiments, the reflection surface has a mean roughness depth Rz (according to DIN EN ISO 4287) of at least roughly 0.8 μm or at least roughly 1 μm or at least roughly 1.6 μm. In certain embodiments the mean roughness depth Rz is not more than about 3.5 μm or not more than about 3 μm or not more than about 2.5 μm. In other embodiments the mean roughness depth Rz is in a range between about 5.5 μm and about 15 μm or in a range between about 8 μm and about 12.5 μm. Alternatively or in addition, the desired scatter effect of the reflection surface can be achieved by adjusting a suitable defined gloss level of the reflection surface, in particular if the reflection surface is formed by a lacquered or coated (e.g. anodised, chromium-plated or powder-coated) area of the reflector body. In certain embodiments the reflection surface has a gloss level (according to DIN 67 530/ISO 2813) at a 60° measuring angle of at most about 70 GU or at most about 60 GU or at most about 50 GU or at most about 40 GU or at most about 30 GU or at most about 20 GU or at most about 10 GU (corresponding to a silk gloss, silk matt, matt or even dull matt appearance of the reflection surface).

In certain embodiments, the window element has a light transmission in the visible spectrum in a range between about 80% and about 98%. For example, the light transmission of the window element lies in a range between about 85% and about 95%.

In certain embodiments, the window element and the reflection surface extend substantially over the entire bar length of the light bar. The light bar itself can have a linear extension in the longitudinal bar direction; alternatively it can have a curved progression.

According to another aspect, the invention provides a shelf assembly for the storage of objects, in particular in a domestic refrigerator. The shelf assembly comprises a shelf element, which forms a storage surface for objects on a first flat side, and a light bar of the type explained above mounted on the shelf element. The light bar is arranged on a second flat side of the shelf element lying opposite the first flat side.

In certain embodiments, the shelf element has a quadrangular shape in a plan view of one of the two flat sides, wherein the light bar—when viewed in a direction transverse to the longitudinal bar direction—extends closer along a first of the quadrangular edges than along an opposing second quadrangular edge of the shelf element and the first portion of the light beam of each light element (which is directed onto the reflection surface) lies closer to the first quadrangular edge than the second portion of the light beam (which is directed past the reflection surface onto the light exit window).

According to yet another aspect, the invention provides for a cooling appliance of household equipment, wherein the cooling appliance comprises a product drawer that is movable between an inserted position and a pull-out position, and a cover shelf arranged above the product drawer to cover it, relative to which the product drawer can be withdrawn from the inserted position to the pull-out position. The cover shelf is formed by a shelf assembly of the type explained above.

The invention is explained further below by means of the enclosed drawings.

DETAILED DESCRIPTION OF THE INVENTION

Figure 1:
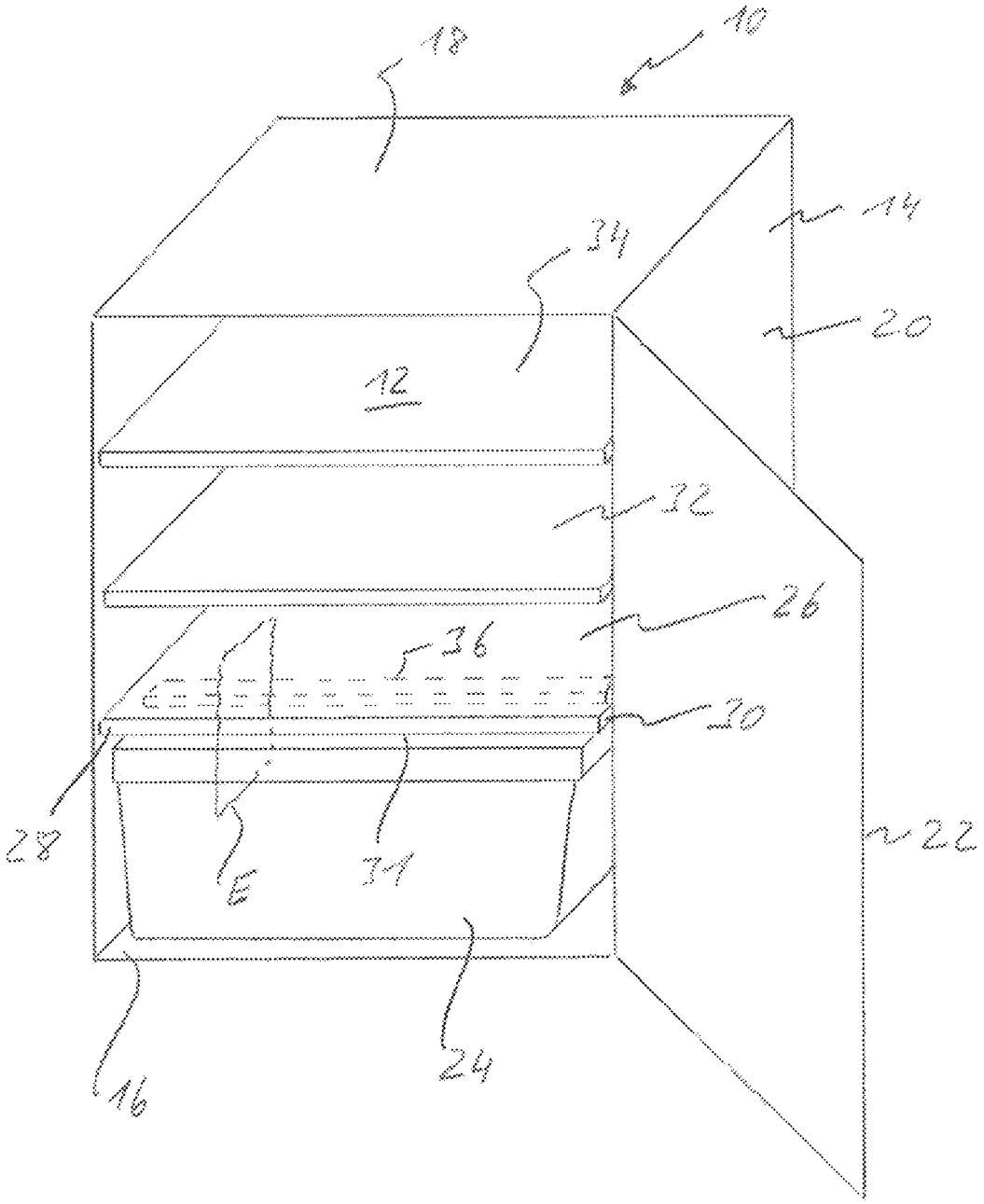
FIG. 1 is a domestic refrigerator in a schematic view according to an exemplary embodiment.

Reference is made first to FIG. 1. The appliance depicted there is generally designated 10. This is a cabinet refrigerator, which is used for the cool storage of foods and provides a cooling space 12 for this, in which temperatures around freezing point or slightly above prevail, for example. In certain embodiments the refrigerator 10 can have a separate freezer compartment to freeze foods. The refrigerator 10 has a cabinet body 14 with a bottom wall 16, a top wall 18, a rear wall, which is not recognisable more closely in FIG. 1, and two side walls 20. The cabinet body 14 forms an access opening framed by the bottom wall 16, the top wall 18 and the two side walls 20, which opening can be closed by a cabinet door 22 hinged pivotably about a vertical pivot axis on one of the side walls 20 and through which the cooling space 12 is accessible.

The cooling space 12 can be equipped with a plurality of built-in components, which are suitable for the storage or deposition of foods. In the example shown in FIG. 1, these built-in components include a pull-out drawer 24, which is shown in its inserted position in the illustration in FIG. 1 and is covered on the upper side by a shelf 26. The shelf forms a surface for foods, which can be stored on the shelf 26. It can be removable from the cooling space 12, but does not move with the drawer 24 when this is pulled out, but remains stationary. The inside of the drawer becomes accessible by pulling out the drawer 24. The shelf 26 has a front shelf edge 28, two shelf side edges 30 opposite one another and a shelf rear edge, which is not shown in greater detail in FIG. 1, and has a generally quadrangular, typically rectangular shelf outline. For goods storage the shelf 26 has at least one shelf element 31. The shelf element 31 is configured, for example, in the manner of a plate and forms a continuous goods storage surface, which can be flat or alternatively can be executed e.g. with recesses for storing bottles. The shelf element 31 is opaque in some embodiments, so that no light can pass through the shelf element 31 into the drawer 24. However, it is not excluded that the shelf element 31 is at least partially transparent and is configured e.g. in the manner of a grate or grid.

In the example in FIG. 1, the built-in components of the refrigerator 10 include other shelves 32, 34, which are likewise intended for the storage of foods.

The refrigerator 10 is equipped with lighting means, which illuminate at least parts of the refrigerator 12 when the door 22 is open. The lighting means include a light bar 36 mounted on the shelf 26 and indicated by a dashed line in FIG. 1, which is used to illuminate the interior of the drawer 24 and is arranged on the underside of the shelf 26 (when viewed in the installed situation). The light bar 36 is executed linearly in the example shown and extends along the front shelf edge 28 of the shelf 26 at a distance of a few centimetres, for example, from the front shelf edge 28. The light bar 36 can be removed from the refrigerator 10 together with the shelf 26 as an assembly (so-called shelf assembly). It is understood that the linear configuration of the light bar 36 shown in FIG. 1 is only by way of example; a curved progression of the light bar is alternatively readily imaginable.

The other figures show different exemplary embodiments of the light bar 36. Identical components or structures or those having an identical effect are provided in all figures with the same reference signs, wherein to differentiate the exemplary embodiments shown in the following figures a different small letter is appended to the reference sign used. Unless otherwise indicated below, reference is made to the respectively preceding implementations to explain the relevant components or structures.

Figure 2A:
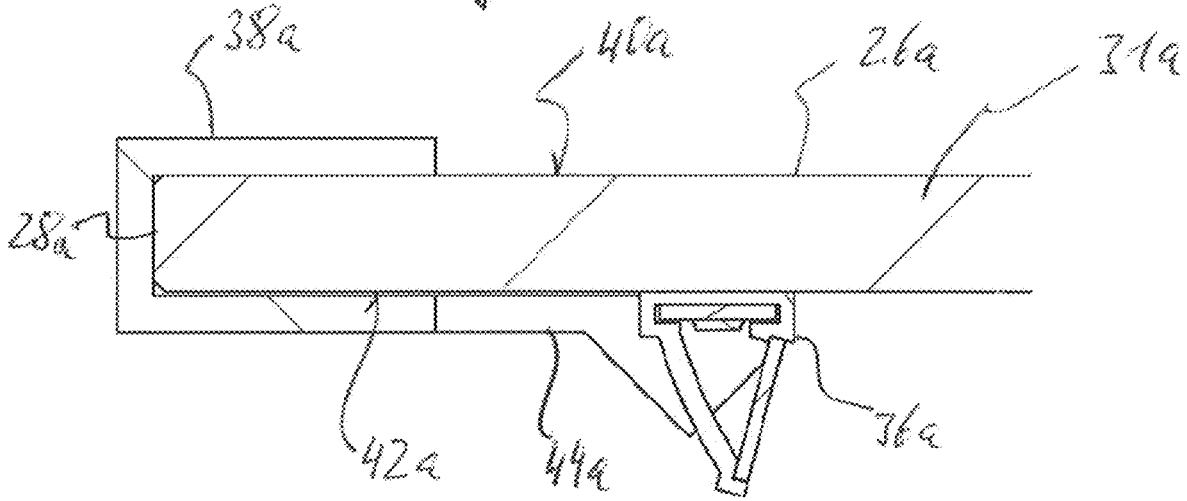
FIG. 2*a* is a shelf assembly with a light bar according to an exemplary embodiment.
Figure 2B:
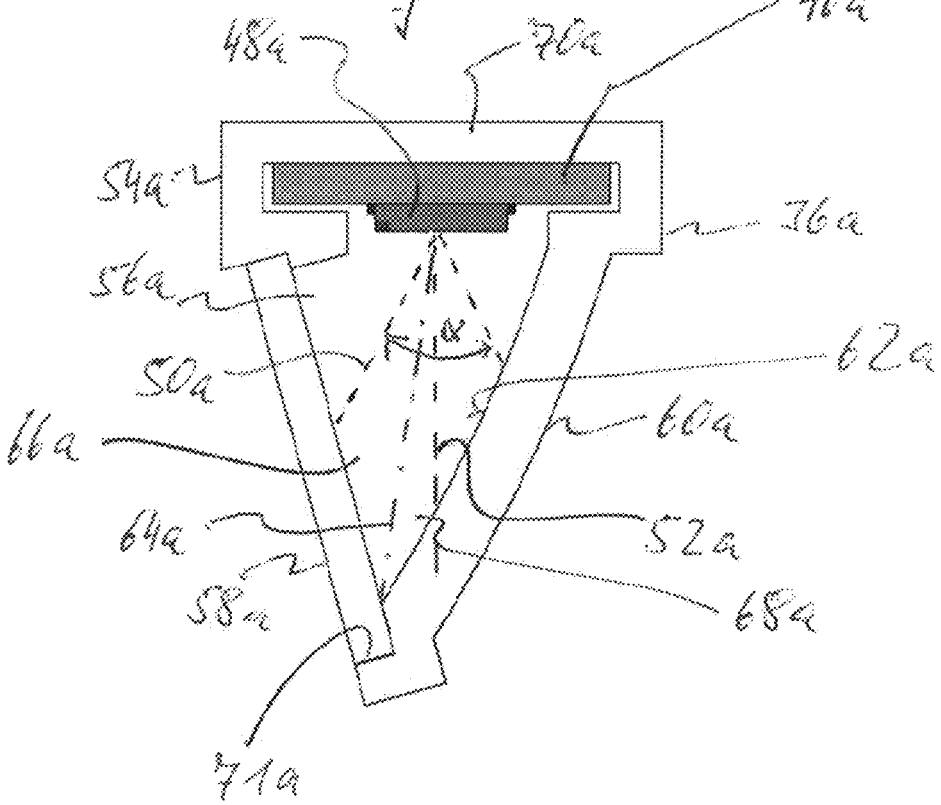
FIG. 2*b* is the light bar of FIG. 2*a* in an enlarged and inverted view.

Reference is made next to the exemplary embodiment according to FIGS. 2*a* and 2*b*. Here FIG. 2*a* corresponds to a depiction in a section plane such as is indicated schematically by E in FIG. 1. FIG. 2*b* shows the light bar 36*a* of FIG. 2*a* in an enlarged and inverted view. In FIG. 2*a* it is recognised that the shelf 26*a* is provided in the area of front shelf edge 28*a* with a protective strip 38*a* serving as edge protection (often termed trim in English technical language), which extends substantially over the entire length of the front shelf edge 28*a*. The protective strip 38*a* has a substantially U-shaped cross section and is put onto the shelf element 31*a* from the front shelf edge 28*a*, so that in the installed situation of the shelf 26*a* an upper flat side (first flat side) 40*a* of the shelf element 31*a* is covered a little way by one of the longer U-limbs of the protective strip 38*a* and a lower flat side (second flat side) in the installation situation is covered a little way by the other of the two longer U-limbs of the protective strip 38*a*. In the area of its strip ends lying opposite in the longitudinal strip direction, the protective strip 38*a* is executed respectively with a bracket extension 44*a*, which forms a suitable bracket (e.g. plug-on or clip bracket) for a respective end piece of the light bar 36*a*. In other words, the light bar 36*a* extends between the two end-side bracket extensions 44*a* of the protective strip 38*a*. An alternative mounting option for the light bar 36*a* consists in attaching this directly to the shelf element 31*a*, for example by gluing.

Instead of a U-shaped cross section, the protective strip 38*a* can alternatively have an approximately L-shaped cross section without the upper of the two longer U-limbs. In this case the shelf element 31*a* can be glued to the protective strip 38*a*. Another alternative configuration consists in manufacturing the protective strip 38*a* not structurally separate from the light bar 36*a*, but producing the protective strip 38*a* in one piece connected to a bar housing of the light bar 36*a* that encloses a cavity all around or at least partially delimits it and to lacquer the component thus created, for example, in order to provide desirable reflection properties of the light bar 36*a*.

The light bar 36*a* has an electrical circuit board 46*a*, on which a plurality of light elements 48*a* is mounted in the longitudinal bar direction at a distance behind one another. The light elements 48*a* each form a white light source and are formed by light-emitting diodes, for example. The spacing of consecutive light elements 48*a* in the longitudinal bar direction of the light bar 36*a* is a few millimetres up to a few centimetres, for example. The circuit board 46*a* is arranged on the underside of the shelf 26*a*, wherein in the example shown the circuit board 46*a* is oriented with its board plane substantially parallel to the shelf plane of the shelf 26*a*. It is understood that the circuit board 46*a* can alternatively be arranged tilted compared with the shelf plane of the shelf 26*a*. In particular, the circuit board 46*a* can be tilted compared with the shelf plane of the shelf 26*a* in such a way that a normal to the board plane of the circuit board 46*a*, when viewed in the section plane of FIG. 2*a*, runs obliquely downwards at the front, wherein at the front refers to the shelf front edge 28*a*.

The light elements 48*a* each radiate light in a light beam, which is indicated in FIG. 2*b* by dashed lines and schematically at 50*a*. The light beam 50*a* has a beam axis 52*a*, which is oriented in the example shown substantially orthogonally to the board plane of the circuit board 46*a*. If the circuit board 46*a* is oriented substantially parallel to the shelf plane of the shelf 26*a*, the beam axis 52*a* then runs substantially orthogonally to the shelf plane of the shelf 26*a*. If the circuit board 46*a* is tilted compared with the shelf plane of the shelf 26*a*, the beam axis 52*a* runs inclined to the shelf plane of the shelf 26*a*. In particular, the beam axis 52*a* can be oriented inclined forwards and downwards in the installed situation of the shelf 26*a*.

The light beam 50*a* can have a circular beam cross section or an e.g. elliptical or even asymmetrical cross section deviating from a circular form. In a section plane containing the beam axis 52*a* and orthogonal to the longitudinal bar direction of the light bar 36*a* (as shown in FIG. 2*b*), the beam angle—designated a in FIG. 2*b*—lies for example in a range of at least 30 degrees or at least 40 degrees or at least 50 degrees or at least 60 degrees or at least 70 degrees or at least 80 degrees and at most 160 degrees or at most 150 degrees or at most 140 degrees or at most 130 degrees or at most 120 degrees. If the light elements 48*a* each radiate light in a main light beam and one or more side light beams, the light beam 50*a* describes such a main light beam. In the light beam 50*a* the intensity of the light can be greatest at the beam axis 52*a* and decrease continuously in the direction of the beam edge, for example.

The light bar 36*a* has a bar housing 54*a*, which has an internal cavity 56*a* that is enclosed all around when viewed in a section orthogonal to the longitudinal bar direction of the light bar 36*a* (as in FIG. 2*b*). The circuit board 46*a* with the light elements 48*a* mounted thereon is inserted into the internal cavity 56*a* and is arranged therein, for example, by suitable form-locking means and/or by gluing and/or other bonding techniques in a positionally stable manner. In the example shown, the bar housing 54*a* forms an insertion guide, into which the circuit board 46*a* is inserted on assembly of the light bar 36*a* and which at the same time assumes a holding function for the circuit board 46*a*.

Part of the bar housing 54*a* is formed by an in particular translucent window element 58*a* that is permeable for the light of the light elements 48*a* (transmission in the visible range, for example, between roughly 85 and 95%), through which window element the light radiation by the light bar 36*a* takes place. It is recognised in FIG. 2*b* that the window element 58*a* is arranged so that a portion of the light beam 50*a* of each light element 48*a* directly encounters the window element 58*a*. Another part of the bar housing 54*a* is formed by a reflector body 60*a*, which on its internal surface facing the internal cavity 56*a* forms a reflection surface 62*a*, on which incident light is reflected diffusely. The reflector body 60*a* is opaque, due to which no light losses occur through the reflector body 60*a*. The scatter properties of the reflection surface 62*a* are guaranteed by a suitable surface roughness, for example. Alternatively or in addition, a scatter behaviour of the reflection surface 62*a* can be achieved by a silk matt or matt surface coating of the reflector body 60*a*, for example.

It is recognised in FIG. 2*b* that the remaining portion of the light beam 50*a*, which does not directly impinge on the window element 58*a*, first encounters the reflection surface 62*a*, where it is reflected diffusely. The light of the light bar 36*a* emerging from the window element 58*a* is consequently composed of a proportion that impinges directly on the window element 58*a* from the light elements 48*a* and a further proportion that first impinges on the reflection surface 62*a* from the light elements 48*a* and following diffuse reflection passes to the window element 58*a* and exits the light bar 36*a* through this.

A boundary line is indicated by a dotted and dashed line at 64*a* in FIG. 2*b*, which illustrates the boundary between that portion of the light beam 50*a* that directly encounters the window element 58*a* without previous scattering at the reflection surface 62*a*, and that portion of the light beam 50*a* that first impinges on the reflection surface 62*a* before the light of this portion of the light beam 50*a* encounters the window element 58*a*. When viewed in a beam cross section orthogonal to the beam axis 52*a*, the two portions of the light beam 50*a* separated by the boundary line 64*a* each account for at least around a quarter or a third of the beam cross section in some embodiments. In the example shown in FIG. 2*b*, the portion of the light beam 50*a* that impinges directly on the window element 58*a* without previous scattering at the reflection surface 62*a* (this portion is designated 66*a*) is smaller when viewed in the beam cross section than the portion of the light beam 50*a* that first encounters the reflection surface 62*a* (the latter portion is designated 68*a*). The beam axis 52*a* lies in the portion 68*a* of the light beam 50*a*.

By suitable configuration of the window element 58*a* and the reflector body 60*a*, in particular by suitable adjustment of the relative magnitudes of the light beam portions 66*a*, 68*a* relative to one another, a desired radiation characteristic of the lightbar 36*a* can be achieved, in which—in the section plane in FIG. 2*b*—radiation substantially exclusively of scattered light occurs in a direction parallel to the shelf plane of the shelf 26*a*, and in a direction within the angular range of the light beam portion 66*a* radiation at least mostly of direct light takes place, which has impinged directly on the window element 58*a* without previous scattering on the reflection surface 62*a*. It is thus possible to illuminate diffusely the areas of a product drawer (e.g. the drawer 24 in FIG. 1) lying further back, and on the other hand to illuminate the areas of the drawer lying further forward increasingly by direct light.

In certain embodiments a lens element can be arranged in the light path between the light elements 48*a* and the bar housing 54*a* (specifically the window element 58*a* and the reflector body 60*a*), which lens element is used to increase or reduce the divergence of the light radiated by the light elements 48*a*. Although the light beam 50*a* emitted by the light elements 48*a* is changed by such a lens element to a stepped beam, a portion of the resulting stepped light beam still impinges directly on the window element 58*a*, while another portion (remaining portion) first encounters the reflection surface 62*a*.

The reflector body 60*a* in the example shown in FIG. 2*b* is a one-piece part of a housing main body 70*a* of the bar housing 54*a*, which is executed with suitable bracket formations (here an insertion guide) for the circuit board 46*a*. It is understood that in other embodiments the bar housing 54*a* can have a bracket body for the circuit board 46*a* that is separate from the reflector body 60*a*. The housing main body 70*a* is a surface-coated aluminium extrusion, for example, or can be executed as an injection-moulded or extruded plastic component. The reflection surface 62*a* in certain embodiments is formed by a white material. The housing main body 70*a* has a window opening 71*a*, into which the window element 58*a* produced as a separate component is inserted.

Figure 3A:
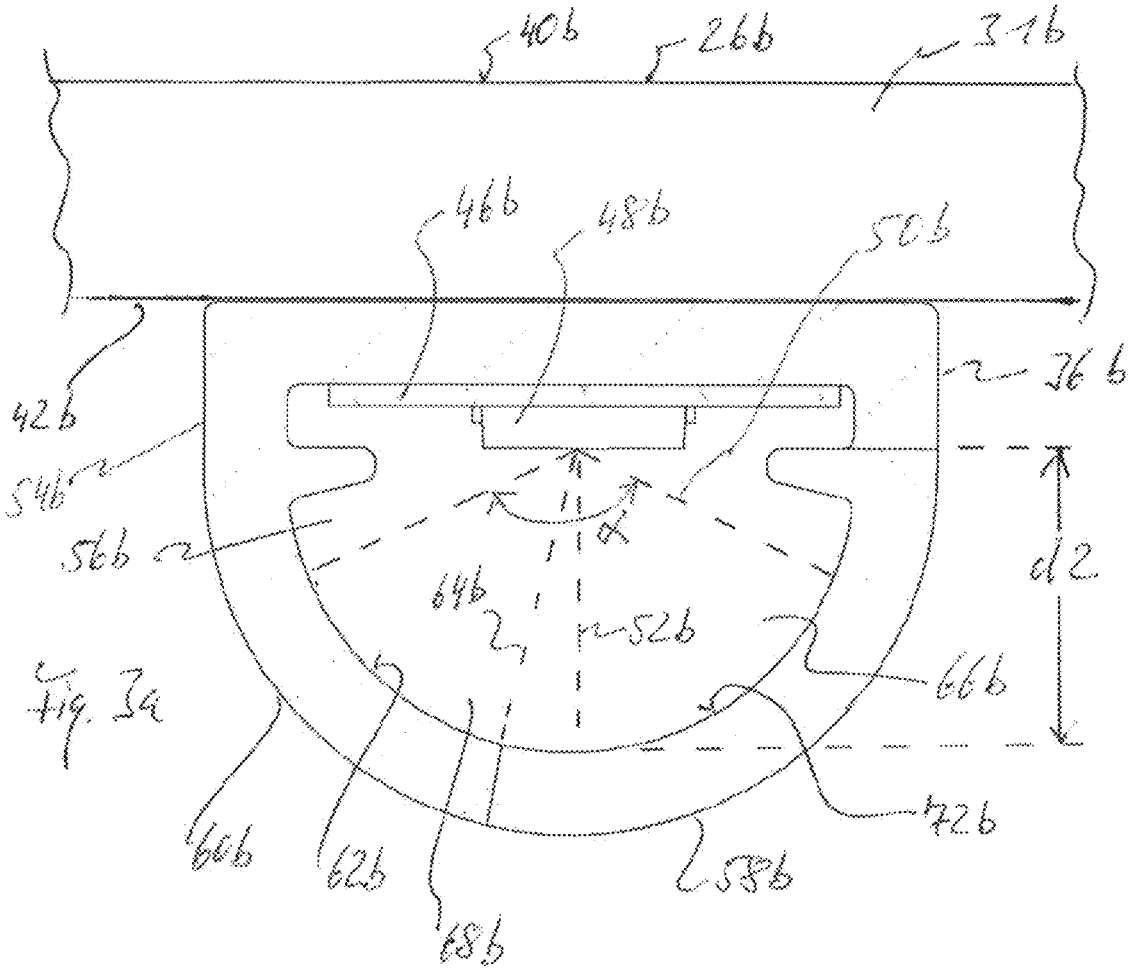
FIG. 3*a* is a shelf assembly with a light bar according to another exemplary embodiment.
Figure 3B:
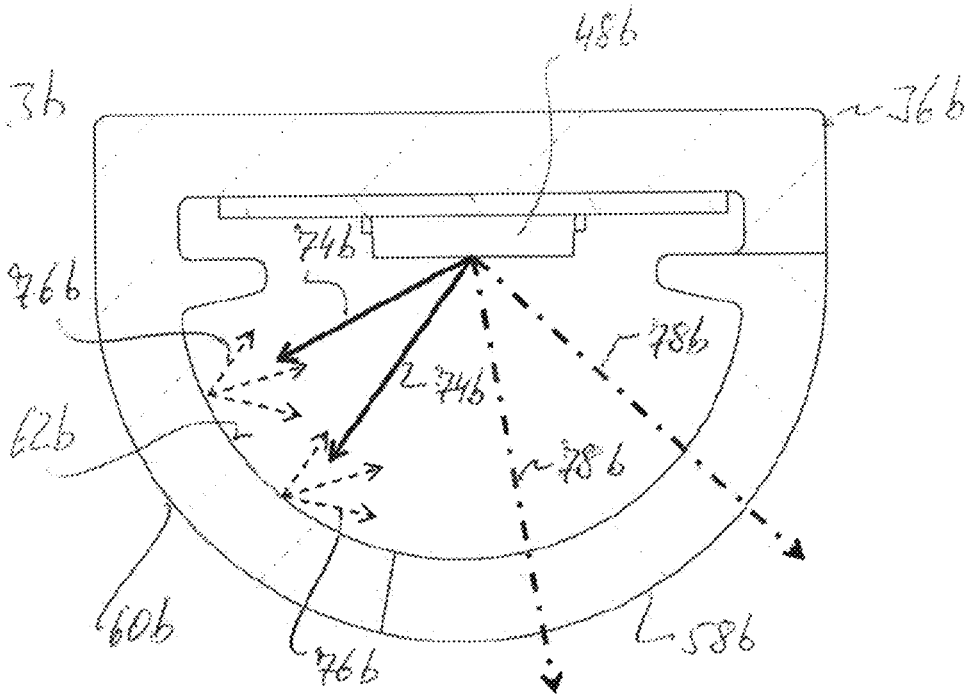
FIG. 3*b* is the light bar of FIG. 3*a*.
Figure 3C:
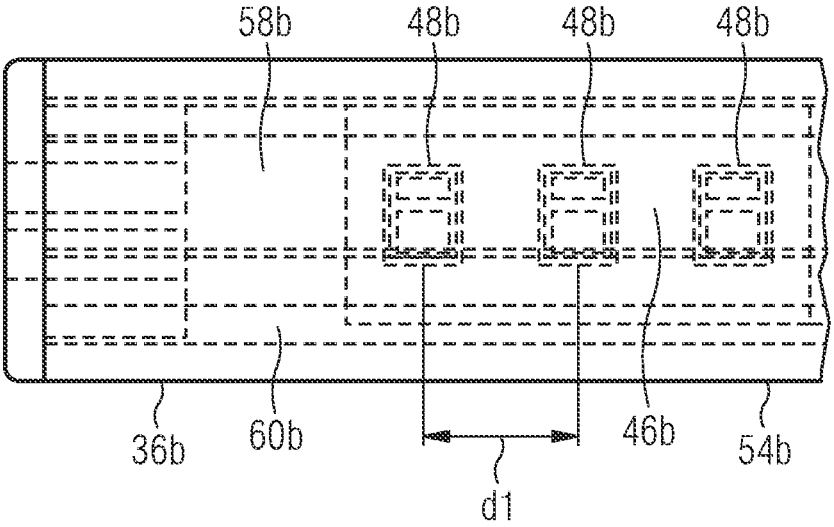
FIG. 3*c* is a view of a longitudinal part of the light bar of FIG. 3*a*.

Reference is now made to the exemplary embodiment of FIGS. 3*a* to 3*c*. The light bar 36*b* shown there differs from the light bar 36*a* of FIGS. 2*a*, 2*b* due to a substantially kink- and step-free configuration of the cavity surface (designated 72*b*) bordering the internal cavity 56*b* at least within the angular range of the light beam 50*b*, thus where the light beam 50*b* impinges on the cavity surface 72*b*. In this angular range in the example shown—when viewed in the bar cross section—the cavity surface 72*b* is configured with an at least approximately circular progression, wherein the centre of the circle lies on or near the beam axis 52*b*, for example in the area of the apex of the light beam 50*b*.

Another difference from the exemplary embodiment of FIGS. 2*a*, 2*b* consists in the fact that in the light bar 36*b* of FIGS. 3*a* to 3*c*, the beam axis 52*b* lies inside the light beam portion 66*b* and outside the light beam portion 68*b*; the light beam portion 66*b* extends in the bar cross section over a greater angular range than the light beam portion 68*b*, in contrast to the exemplary embodiment according to FIGS. 2*a*, 2*b*, where the light beam portion 66*a* extends over a smaller angular range than the light beam portion 68*a*.

The window element 58*b* can be a constituent of the bar housing 54*b* that is connected in one piece to the reflector body 60*b*. For example, the bar housing 54*b* can be manufactured in a two-component injection moulding process or a two-component extrusion process from plastic material. Here a first plastic material, which guarantees the desired light permeability of the window element 58*b*, can be used for the window element 58*b*, while for the remaining areas of the bar housing 54*b* (including the reflector body 60*b*), another, light-impermeable plastic material can be used.

The reflection surface 62*b* in the exemplary embodiment of FIGS. 3*a* to 3*c* forms part of the cavity surface 72*b*.

The centre distance of consecutive light elements 48*b* measured in the longitudinal bar direction of the light bar 36*b*—which distance is designated by d1 in FIG. 3*c*—is smaller than the radial distance between the light elements 48*b* and the reflection surface 62*b* (designated d2 in FIG.

3*a*). By adhering to the stipulation d2>d1 good homogenisation of the light radiated by the light elements 48*b* in the longitudinal bar direction is achievable. If the distance d1 were selected to be significantly greater than the measurement d2, it could not be excluded that marked variations in the brightness of the light radiated by the light bar 36*b* manifest themselves in the longitudinal bar direction.

FIG. 3*b* illustrates the functional principle of the light bar according to the invention. Solid arrows 74*b* illustrate light rays that are radiated by a light element 48*b* in the direction of the reflection surface 72*b* and are scattered diffusely on their impingement on the reflection surface 62*b*. The resulting scattered light rays are indicated by dashed lines at 76*b*. In contrast, dashed and dotted arrows 78*b* illustrate light rays that are radiated by the relevant light element 48 in the direction of the window element 58*b* and experience no reflection at the reflection surface 62*b* before they exit the light bar 36*b*.

Figure 4A:
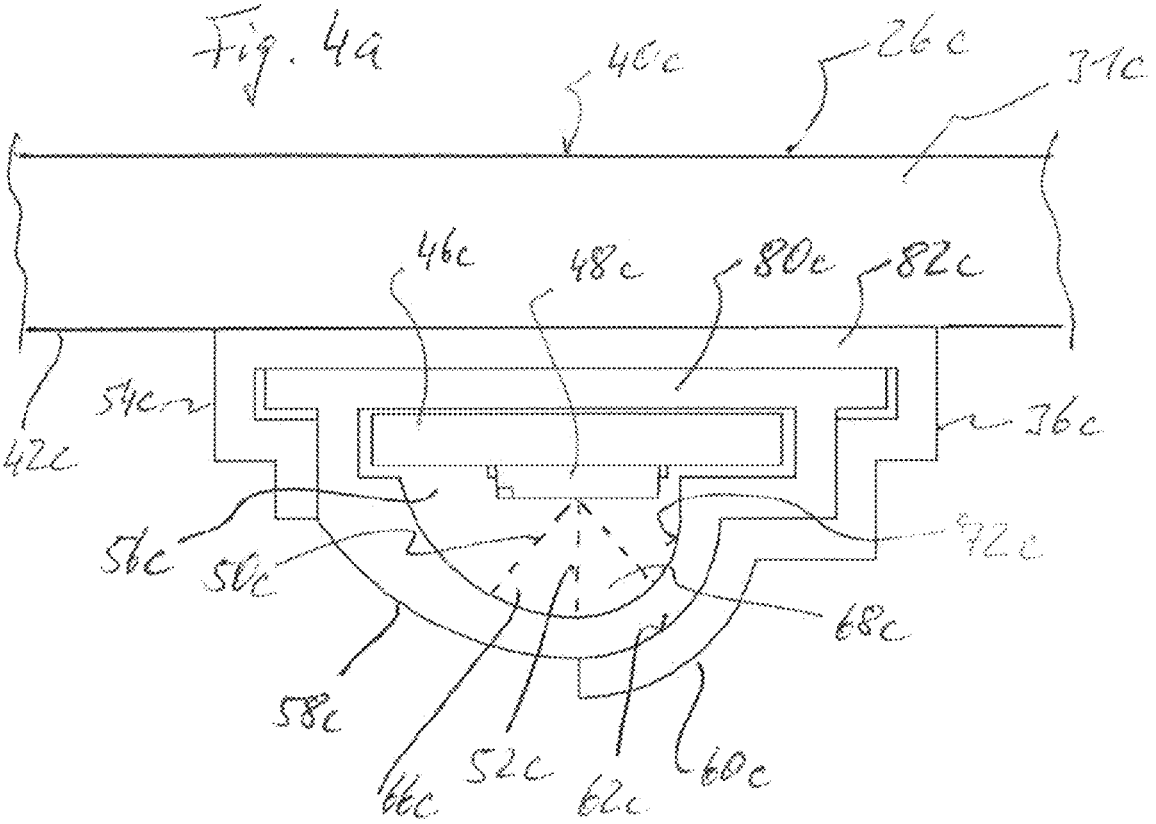
FIG. 4*a* is a shelf assembly with a light bar according to yet another exemplary embodiment.
Figure 4B:
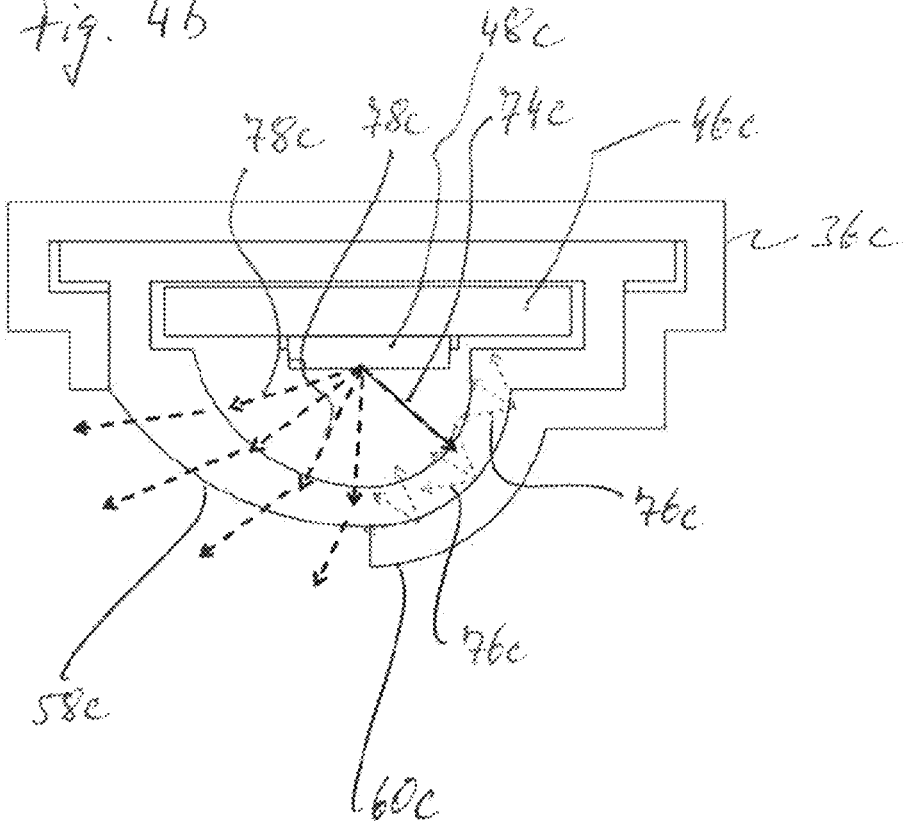
FIG. 4*b* is the light bar of FIG. 4*a*.

The exemplary embodiment of FIGS. 4*a*, 4*b* differs from the previous exemplary embodiments due to the configuration of the bar housing 54*c* of the light bar 36*c*. The bar housing 54*c* is executed in multiple parts and comprises an internal housing part 80*c* and an external housing part 82*c*. The internal cavity 56*c* is formed in the internal housing part 80*c*, which accordingly encloses the internal cavity 56*c* all around when viewed in the bar cross section. The internal housing part 80*c* forms the window element 58*c* at the same time and can accordingly be formed as a whole from the same light-permeable (plastic) material from which the window element 58*c* is formed. The external housing part 82*c* encloses the internal housing part 80*c* on a portion of its external circumference (again when viewed in the bar cross section) and is pushed or plugged onto the internal housing part 80*c* in the longitudinal bar direction, for example, and held on the internal housing part 80*c* by a snap or latch connection. The external housing part 82*c* forms the reflector body 60*c* and can be formed accordingly as a whole from the same light-impermeable material from which the reflector body 60*c* is formed.

Because the internal housing part 80*c* extends with the window element 58*c* into the angular range of the light beam portion 68*c*, the light rays of the light beam portion 68*c* first pass through the window element 58*c* before they encounter the reflection surface 62*c* and are reflected there diffusely. The reflection surface 62*c* accordingly forms no part of the cavity surface 72*c* in the exemplary embodiment of FIGS. 4*a*, 4*b*, but lies outside this.

Another difference from the previous exemplary embodiments is that the beam axis 52*c* lies substantially on the boundary line between the two light beam portions 66*c*, 68*c*.

FIG. 4*b* illustrates in turn—similar to FIG. 3*b*—direct light rays 78*c*, which are radiated by one of the light elements 48*c* inside the angular range of the light beam portion 66*c* (and which are accordingly not scattered on the reflection surface 62*c*), and a light ray 74*c*, which is radiated by the relevant light element 48*c* within the angular range of the light beam portion 68*c* in the direction of the reflection surface 62*c*.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A light bar for installation in a household electrical appliance, for example a refrigerator, comprising:

an arrangement of a plurality of light elements arranged mutually spaced behind one another in a longitudinal bar direction of the light bar, wherein each of the plurality of light elements is configured to produce a light beam;

a light-impermeable reflector body having a reflection surface, the reflection surface configured to produce a diffusely scattering effect, wherein a first portion of the light beam of each of the plurality of light elements is directed at the reflection surface; and a light-permeable window element, at which light produced by the plurality of light elements exits the light bar, wherein a second portion of the light beam different from the first portion is directed past the reflection surface to the light-permeable window element, characterized in that the light bar comprises a one-piece light bar housing manufactured in a two-component injection moulding process or a two-component extrusion process, the light bar housing—when viewed in a section orthogonal to the longitudinal bar direction—having an internal cavity that is closed all around with the plurality of light elements being arranged on a circuit board inserted into the internal cavity, wherein a region of the light bar housing forming the window element is formed from light-permeable plastic material and a region of the light bar housing forming the reflector body is formed from light-impermeable plastic material.

2. The light bar according to claim 1, wherein when viewed in a section orthogonal to the longitudinal bar direction, the first portion and the second portion of the light beam of each light element adjoin one another.

3. The light bar according to claim 1, wherein each of the first portion and the second portion is at least about a fifth or at least about a quarter or at least about a third of the cross section of the light beam.

4. The light bar according to claim 1, wherein the plurality of light elements are arranged on the circuit board with a beam axis of the light beam of each of the plurality of light elements being at least approximately perpendicular to the board plane of the circuit board.

5. The light bar according to claim 1, wherein the internal cavity of the light bar housing is limited by a cavity surface, which, when viewed in a section orthogonal to the longitudinal direction of the bar, runs in a curve shape at least within the angular range of the light beam of each light element, in particular substantially in the shape of an arc of a circle, curved at a distance from the circuit board, wherein a portion of the cavity surface lying within the angular range of the light beam of each light element is formed in a first partial angular range by the window element and the reflection surface is arranged within a second partial angular range.

6. The light bar according to claim 5, wherein the cavity surface is formed in the second partial angular range by the reflection surface.

7. The light bar according to claim 5, wherein a distance of each light element from the cavity surface measured perpendicular to the board plane of the circuit board is greater than a centre distance of consecutive light elements.

8. The light bar according to claim 1, wherein the reflection surface has a mean roughness depth Rz of at least around 0.8 μm or at least roughly 1 μm or at least roughly 1.6 μm and/or a gloss level at a 60° measuring angle of at most about 70 GU or at most about 60 GU or at most about 50 GU or at most about 40 GU or at most about 30 GU or at most about 20 GU or at most about 10 GU.

9. The light bar according to claim 1, wherein the window element has a light transmission in the visible spectrum in a range between about 80% and about 98%.

10. The light bar according to claim 1, wherein at least one of the following is satisfied:

(i) the window element and the reflection surface extend substantially over the entire bar length of the light bar; or (ii) the light bar extends linearly in its longitudinal bar direction; or (iii) the light bar is curved.

11. A shelf assembly for storing objects, comprising a shelf element, which forms a storage surface for objects on a first flat side, and a light bar according to claim 1 mounted on the shelf element, wherein the light bar is arranged on a second flat side of the shelf element lying opposite the first flat side.

12. The shelf assembly according to claim 11, wherein the shelf element in a top view onto one of the two flat sides has a quadrangular outline and the light bar, when viewed in a direction transverse to the longitudinal bar direction, extends closer along a first of the quadrangular edges than along an opposing second quadrangular edge of the shelf element and the first portion of the light beam of each light element lies closer to the first quadrangular edge than the second portion of the light beam.

13. A cooling appliance of household equipment, comprising a product drawer that is movable between an inserted position and a pull-out position and a covering shelf arranged above the product drawer to cover it, relative to which the product drawer can be withdrawn from the inserted position into the pull-out position, wherein the covering shelf is formed by a shelf assembly according to claim 11.

* * * * *